US009493283B2

(12) United States Patent
Tuyn

(10) Patent No.: US 9,493,283 B2
(45) Date of Patent: Nov. 15, 2016

(54) BOTTLE CAP ATTACHMENT MECHANISM

(71) Applicant: Bradley P. Tuyn, Ft. Lauderdale, FL (US)

(72) Inventor: Bradley P. Tuyn, Ft. Lauderdale, FL (US)

( * ) Notice: Subject to any disclaimer, the term of this patent is extended or adjusted under 35 U.S.C. 154(b) by 0 days.

(21) Appl. No.: 14/450,823

(22) Filed: Aug. 4, 2014

(65) Prior Publication Data

US 2015/0183561 A1 Jul. 2, 2015

Related U.S. Application Data

(60) Provisional application No. 61/861,582, filed on Aug. 2, 2013.

(51) Int. Cl.
*B65D 55/16* (2006.01)

(52) U.S. Cl.
CPC ..... *B65D 55/16* (2013.01)

(58) Field of Classification Search
CPC ... B65D 55/16; B65D 55/165; A61J 11/008; A61J 9/085; B65F 1/16
USPC ..... 220/375; 215/276, 258, 306
See application file for complete search history.

(56) References Cited

U.S. PATENT DOCUMENTS 524,159 A * 8/1894 Birnbaum ..... B65D 41/28 215/277
1,611,852 A * 12/1926 Simon ..... B65D 35/42 220/288
1,924,242 A * 8/1933 Kaye ..... B65D 55/16 215/306
2,468,758 A * 5/1949 Johnson ..... B65D 39/08 220/288
2,854,789 A * 10/1958 Berry ..... A63H 5/00 220/375
3,306,483 A * 2/1967 Bellafiore ..... B65D 35/42 215/306
3,490,177 A * 1/1970 Perrion ..... 49/463
D221,885 S * 9/1971 Gruett ..... D15/150
3,874,570 A * 4/1975 Katzman ..... B65D 35/42 220/288
4,077,537 A * 3/1978 Libit ..... B65D 41/50 215/253
4,339,056 A * 7/1982 Berkstresser et al. ..... 220/375
4,669,641 A * 6/1987 Holmes ..... B65D 55/16 215/306
5,150,808 A * 9/1992 Hamilton ..... B60K 15/0406 220/255
5,178,308 A * 1/1993 Endre ..... B62J 11/00 215/306
D342,449 S * 12/1993 Mattheis ..... D9/446
D377,146 S * 1/1997 Schmidiger ..... D9/499
5,605,241 A * 2/1997 Imperioli ..... 215/306
5,653,353 A * 8/1997 Otto et al. ..... 215/306
5,984,127 A * 11/1999 Fenton ..... 220/254.1
6,041,960 A * 3/2000 Leal ..... B65F 1/1615 215/306
6,059,136 A * 5/2000 Lin ..... 220/212.5
6,085,931 A * 7/2000 Sadow ..... 220/375
6,206,223 B1 * 3/2001 Wicker ..... 220/375
6,588,622 B1 * 7/2003 Leishman et al. ..... 220/719
D478,005 S * 8/2003 Sali ..... D9/446
6,622,356 B2 * 9/2003 Doshi et al. ..... 24/660
6,648,158 B1 * 11/2003 Lawrence ..... B65D 55/16 215/306
6,681,950 B2 * 1/2004 Miller et al. ..... 220/495.11
7,182,215 B1 * 2/2007 Clardy ..... 220/287
7,398,891 B2 * 7/2008 Yang ..... A45F 3/20 215/306
8,016,111 B2 * 9/2011 Wilson ..... A45F 5/1046 206/493
8,443,994 B1 * 5/2013 Desselle ..... 215/306
8,752,720 B1 * 6/2014 Habig et al. ..... 215/306
8,783,487 B2 * 7/2014 Hojo ..... 215/386
2003/0019871 A1 * 1/2003 Nance ..... 220/23.4
2004/0217117 A1 * 11/2004 Lien ..... A45F 3/20 220/375

(Continued)

*Primary Examiner* — Steven A. Reynolds
(74) *Attorney, Agent, or Firm* — Fredrikson & Byron, P.A.

(57) ABSTRACT

A bottle cap attachment mechanism that secures a cap to a bottle even when the cap is removed from the bottle. The cap stays secure to the bottle even while a user is drinking the contents of the bottle.

9 Claims, 5 Drawing Sheets

(56) References Cited

U.S. PATENT DOCUMENTS

| | | | | |
|---|---|---|---|---|
| 2004/0251263 | A1* | 12/2004 | Jaeger | 220/845 |
| 2006/0037959 | A1* | 2/2006 | Hokazono et al. | 220/303 |
| 2008/0023478 | A1* | 1/2008 | Cahill | 220/375 |
| 2008/0237237 | A1* | 10/2008 | Watson | 220/375 |
| 2010/0170819 | A1* | 7/2010 | Skinner et al. | 206/459.5 |
| 2013/0043251 | A1* | 2/2013 | Hendey, III | 220/375 |
| 2013/0105485 | A1* | 5/2013 | Bork | 220/375 |
| 2013/0153590 | A1* | 6/2013 | Reitzig | 220/730 |
| 2015/0251795 | A1* | 9/2015 | Tsui | A45C 7/0031 215/306 |

* cited by examiner

BOTTLE CAP ATTACHMENT MECHANISM

RELATED APPLICATIONS

This application claims priority to provisional application No. 61/861,582 filed Aug. 2, 2013 entitled "Bottle Cap Attachment Mechanism" the teachings of which are all incorporated herein by reference.

BACKGROUND

Plastic (PET) bottle cap attachment mechanism, designed with an elastic polyurethane cord, for example, that is commercially available and made by Pepperell Braiding Company. This Bottle Cap Attachment Mechanism connects any shape plastic (Types 1-5) threaded cap to any shape or size plastic (PET) Type 1 bottle or base.

Threaded cap types that may be attached by this mechanism include, but are not limited to, dome caps (as shown in Photograph 2), smooth caps, ribbed caps, brush caps, phenolic caps, tamper evident caps, spout caps and plastic dropper tip caps of any size. While preferred embodiments are shown using plastic threaded caps and bottles, the embodiments of this invention may also be used with aluminum or other forms of metal threaded or unthreaded caps and bottles.

The embodiments of this invention solve three main problems:

No more,

1. Lost Caps—eliminates lost or missing plastic bottle caps by keeping cap attached to bottle at all times.
2. Waste—reduces amount of plastic waste by keeping plastic cap attached to bottle at all times.
3. Inconvenience—alleviates need to reapply cap or hold in hand when walking, biking, driving or exercising by keeping cap attached to bottle at all times.

Embodiments of this invention are different and better than existing plastic bottle cap holders because (i) it is simple and inexpensive to apply for the manufacturer and (ii) practical and not intrusive for the end consumer.

Other forms of plastic bottle cap holders;

Are more expensive to manufacture

May interfere with stacking on shelves or in pallets

May interfere with the mouth or chin during drinking

May leak (as is the case with some forms of flip tops and water bottle sport caps)

Are sometimes cumbersome to take on and off the bottle

Inhibit the flow of carbonated beverages

Other bottle cap attachment mechanisms do not work well primarily due to design flaws, complexity and limited ease of use. Embodiments of this invention improve on other design flaws by creating a simple, inexpensive, almost unnoticeable, small single connection from the bottle's neck to the center of the plastic cap.

DETAILED DESCRIPTION

Embodiments of this invention also allow a convenient solution for any size plastic bottles of carbonated beverages (soda) as there is no restricted mouth opening (sport top) that may inhibit the flow of carbonated beverages.

Figure 1:
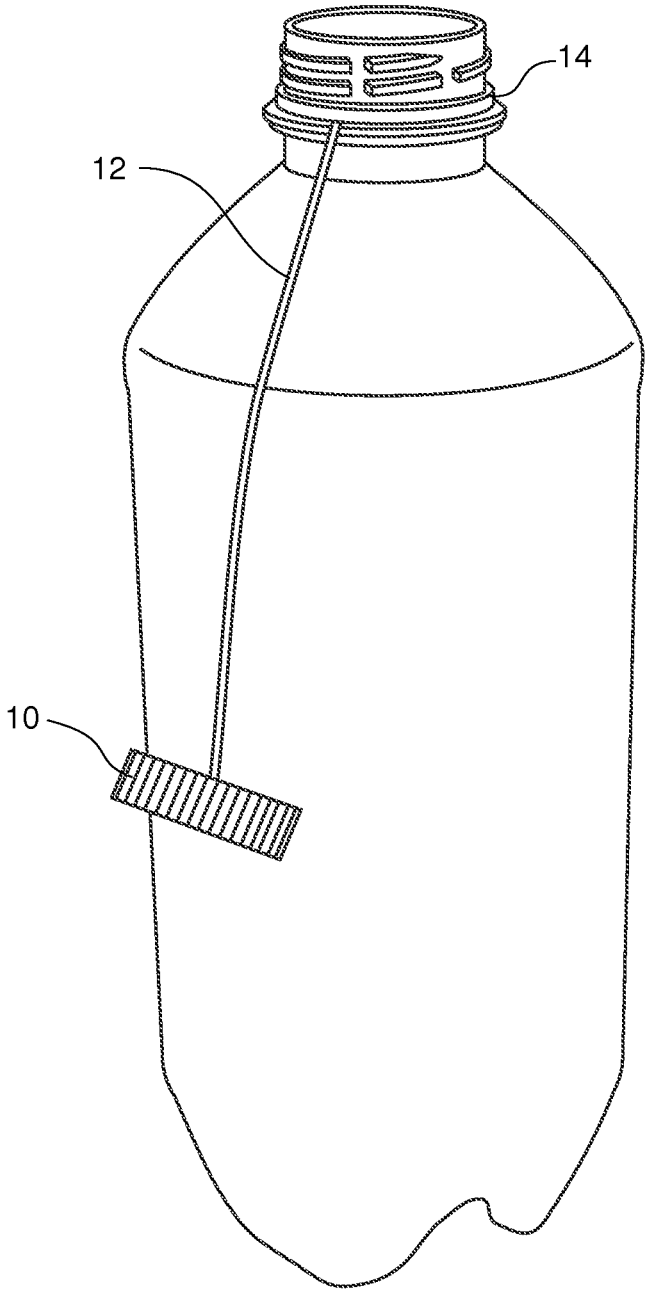
FIG. 1 illustrates an embodiment of the invention.
Figure 2:
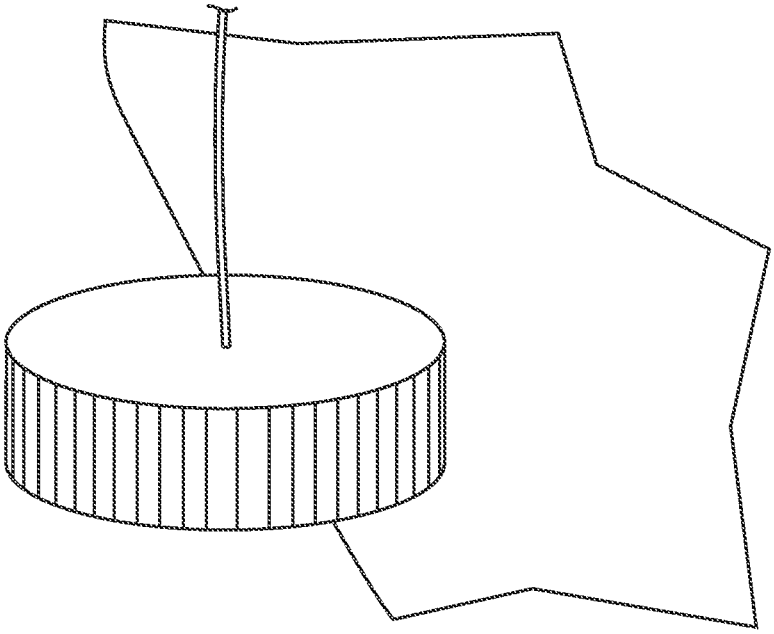
FIG. 2 is a partial expanded view of the cap shown in FIG. 1.
Figure 3:
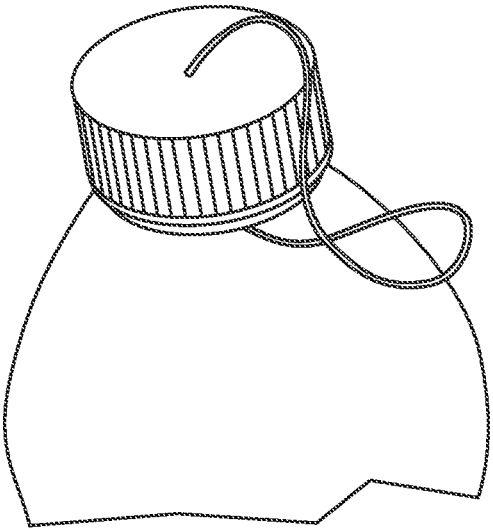
FIG. 3 is a partial expanded view of the cap shown in FIG. 1.

As shown in FIG. 1, the items that make up the Invention:

1. Plastic Cap 10
2. Elastic cord—for example, polyurethane cord, 12
3. Plastic Bottle 14.

1. The cap 10 is connected to the cord 12 by various means such as glue, heat or other possible methods of connection that may be applied to a beverage assembly line or any other plastic bottling process.
2. The cord 12 is connected to the bottle 14 in various ways such as glue, heat or other possible method of connection that may be applied to a beverage assembly line or any other plastic bottling process or by creating a loop of the same elastic cord material as Item 2 around the bottle neck. The loop must be tight enough to securely fit around the respective diameter of the bottle's neck.

The cord 12 is preferably a flexible, elastic polyurethane cord having a diameter ranging from about 0.2 mm to about 0.7 mm diameter and a length ranging from about 3 to about 5 inches, and more preferably 3.75 inches, is attached to the plastic bottle cap's top center by means of heat, glue or any adhesive material or bonding agent. For example, the Working Model (as shown in FIGS. 1-3, and 5 was created by use of a household glue gun and adhesive stick sold at an arts & craft store.

Figure 4:
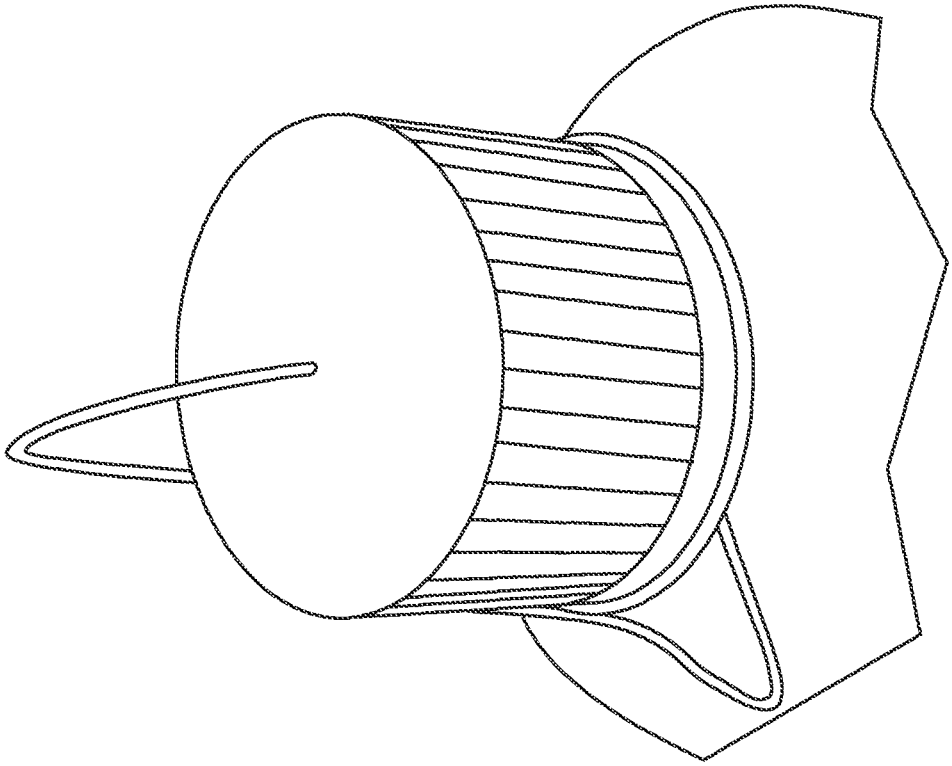
FIG. 4 illustrates still another embodiment of the invention.

As previously stated, the cord 12 may be attached to the neck of the plastic bottle by (i) means of heat, glue or adhesive material or binding agent, (ii) may be tightly looped on one end, around the neck of the bottle or (iii) by puncture into the top cap surface, and threading the cord inside for example (see FIG. 4). Preferably, this third method would require a specific cap with a cavity space that would allow the lower section or surface of the cap to preserve the waterproof seal.

After the cord, between the bottle and cap, makes the connection the cap may then be easily removed by hand. The flexible, elastic nature of the cord allows the consumer to twist the cap with no problem of knotting or tangling, thus no interference with the removal and replacement of the plastic bottle cap.

The specific 3.75" length of the polyurethane cord also allows consumers to drink from the bottle, regardless of size, without interfering with the chin or mouth. The connected cap does not interfere when pouring fluid from the bottle—gravity perpendicular to the (water) bottle pulls water away from bottle's mouth, so there is no surface tension pulling water into the hanging cap.

Figure 5:
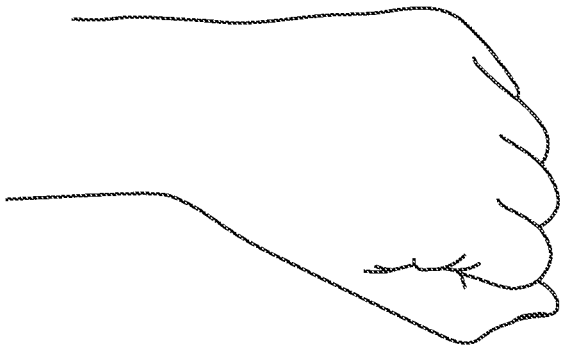
FIG. 5 illustrates another embodiment of the invention.
Figure 5:
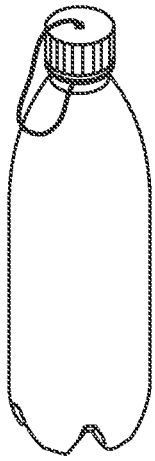

The strong, flexible nature of the connected polyurethane cord to the cap and bottle may also act as a quasi-loop used to hold a water bottle, for example, onto a bicycle handlebar or wall hook, backpack strap or other such object as demonstrated in FIG. 5.

Figure 6:
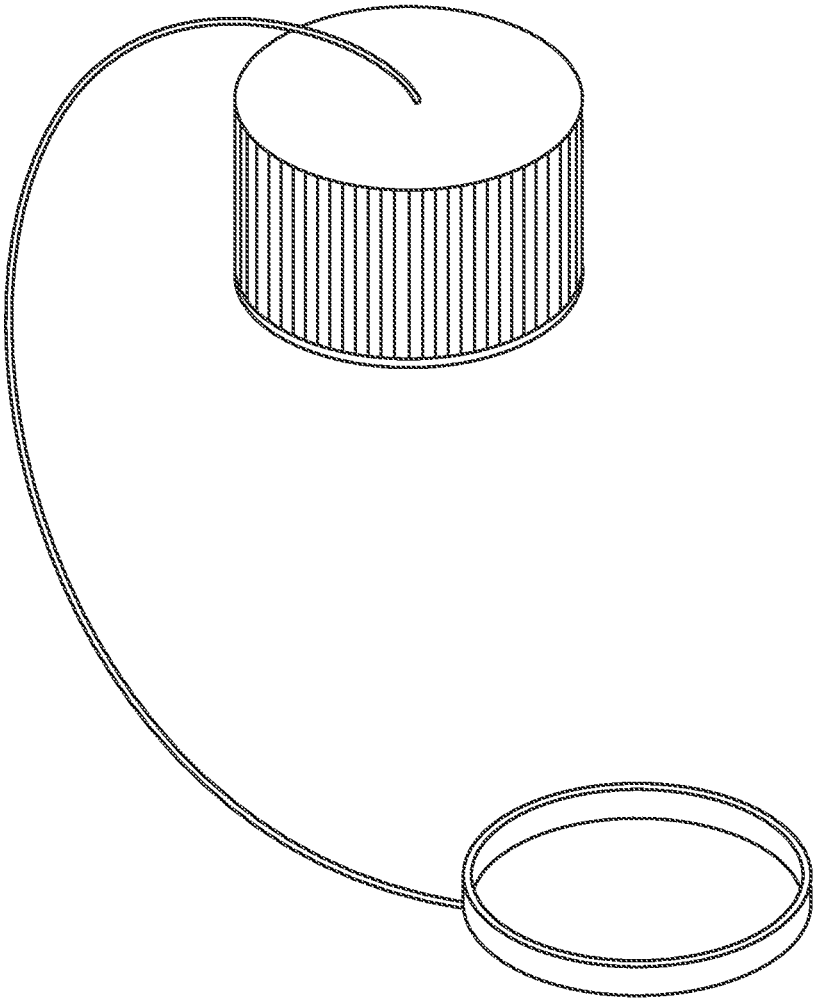
FIG. 6 illustrates another embodiment of the invention undergoing a stress test.

Another embodiment of the invention, as shown in FIG. 6, may be designed as a separately sold assembly—with the cap, cord and bottleneck band.

This version may be sold on its own designed with a universally threaded cap so that they may be utilized with most standard water bottles—in any color. The bottleneck band may be made with polyurethane or a similar elastic rubber material to allow this part of the assembly to attach to any standard size water bottle neck.

The separate assembly may also have commercial branding purposes. For example, a company name may be printed on the elastic band or sports team logo and its respective team color combination.

What is claimed is:

1. An attachment mechanism comprising:

a bottle having a neck and an opening at one end of the neck;

a screw cap configured to seal the open end of the bottle the screw cap having an entirely, substantially flat exterior surface; and a single piece of elastic cord having one end thereof directly, permanently and non-rotatably connected only from the top center of the substantially flat exterior surface of the screw cap and another end connected either to the bottle neck or an upper portion of the bottle.

2. A mechanism according to claim 1 wherein the elastic material is polyurethane.

3. A mechanism according to claim 1 wherein the cord is coupled to the bottleneck and screw cap by any type of glue, cement or bonding agent.

4. A mechanism according to claim 1 wherein the cord is coupled to the bottleneck and the screw cap by a welding process.

5. A mechanism according to claim 1 wherein the cord is coupled to the bottleneck and the screw cap by a heating process.

6. A mechanism according to claim 1 wherein the cord is coupled to the bottle neck by forming a closed-end loop around the bottleneck.

7. A mechanism according to claim 1 wherein the screw cap and the cord are color coordinated.

8. A mechanism according to claim 1 wherein the cord has an optimal length ranging from about 3 inches to about 5 inches.

9. A mechanism according to claim 1 wherein the cord has a thickness or diameter ranging from about 0.2 mm to about 0.7 mm.

* * * * *